US007237520B2

(12) United States Patent
Haefner

(10) Patent No.: US 7,237,520 B2
(45) Date of Patent: Jul. 3, 2007

(54) HYDRAULIC VALVE-LASH-ADJUSTING ELEMENT (HVA)

(75) Inventor: Donald R. Haefner, Troy, MI (US)

(73) Assignee: Schaeffler KG, Herzogenaurach (DE)

( * ) Notice: Subject to any disclaimer, the term of this patent is extended or adjusted under 35 U.S.C. 154(b) by 43 days.

(21) Appl. No.: 11/185,501

(22) Filed: Jul. 20, 2005

(65) Prior Publication Data

US 2006/0016410 A1 Jan. 26, 2006

Related U.S. Application Data

(60) Provisional application No. 60/590,762, filed on Jul. 23, 2004.

(51) Int. Cl.
*F01L 1/14* (2006.01)

(52) U.S. Cl. ..... 123/90.48; 123/90.49; 123/90.52; 123/90.53; 123/90.2; 74/569

(58) Field of Classification Search ..... 123/90.48, 123/90.49, 90.52
See application file for complete search history.

(56) References Cited

U.S. PATENT DOCUMENTS 4,407,241 A * 10/1983 Butler et al. ..... 123/90.16
4,530,320 A * 7/1985 Ferrero ..... 123/90.56
4,601,268 A 7/1986 Rhoads
6,718,923 B2 * 4/2004 Barth et al. ..... 123/90.55

FOREIGN PATENT DOCUMENTS

| | | |
|---|---|---|
| DE | 2 300 467 | 2/1972 |
| DE | 697 07 731 T2 | 2/1997 |
| DE | 197 30 427 A1 | 1/1999 |
| DE | 198 18 893 A1 | 11/1999 |

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

A hydraulic valve-lash-adjusting element (HVA) for the valve train of an internal combustion engine, wherein:

a housing (1) has a blind bore (2) in which a piston (3) is guided with sealing clearance and is in pressure contact with a valve-actuating element (6) and its cam;

the piston (3), together with the blind bore (2), defines a high-pressure space (4) while a low-pressure space (5) is located above the piston (3);

the pressure spaces (4, 5) are connected by at least one central axial bore in the piston (3), this axial bore being controlled by a control valve arranged in the piston (3), wherein the control valve is designed as an exchange valve (11), with a valve body (12) which is guided in a smooth-running manner in the interior of the piston (3), serves to control an upper and a lower central axial bore (14, 15) and the closing movement in both directions of which is the relative movement of the piston (3) in relation to the valve body (12), which is virtually at a standstill because of its mass moment of inertia.

6 Claims, 1 Drawing Sheet

HYDRAULIC VALVE-LASH-ADJUSTING ELEMENT (HVA)

PRIOR APPLICATION

This application is the non provisional application of provisional application Ser. No. 60/590,762 filed Jul. 23, 2004.

FIELD OF THE INVENTION

The invention relates to a hydraulic valve-lash-adjusting element for a valve train of an internal combustion engine, in particular according to the precharacterizing clause of Patent Claims 1 and 10.

BACKGROUND OF THE INVENTION

Hydraulic valve-lash-adjusting elements serve to adjust the lash which forms due to wear or thermal expansion between the transmission elements of the cam lift and the gas-exchange valves of an internal combustion engine. This is intended to achieve a low-noise and low-wear valve train and the greatest possible conformity of cam rise curve and valve travel curve.

A hydraulic valve-lash-adjusting element for the valve train of an internal combustion engine is disclosed in EP 1 298 287 A2 and is characterized by the following features:

- a housing has a blind bore in which a piston is guided with sealing clearance and is in pressure contact with a valve-actuating element and its cam;
- the piston, together with the blind bore, defines a high-pressure space while a low-pressure space is located above the piston;
- the pressure spaces are connected by at least one central axial bore in the piston, this axial bore being controlled by a control valve arranged in the piston.

Control valves of this type are designed as non-return valves. They have a control valve ball which is acted upon by a control valve spring. In the case of the standard construction of the control valve, the control valve spring is acted upon in the closing direction. As a result, the control valve is predominantly closed and an idle travel of the valve-lash-adjusting element is omitted. There is even the risk of the same being pumped up and of a negative valve lash.

These disadvantages are avoided by control valves, the control valve spring of which acts upon the control valve ball in the opening direction. Hydraulic valve-lash-adjusting elements with a control valve of this type, on account of the reversed arrangement of the control valve spring, are called reverse spring hydraulic valve-lash-adjusting elements (RSHLA) or "normally open lash adjusters" (NOLA) because of the control valve which is open in the base circle phase. RSHLAs are distinguished by a positive effect on thermodynamics, pollutant emission and mechanical stressing of the internal combustion engine and are therefore increasingly used.

Since the RSHLA is closed by hydrodynamic and hydrostatic forces only by means of the lubricating oil flow which starts up at the beginning of the cam rise and flows from the high to the low-pressure space, the RSHLA always has an idle travel before the beginning of the valve travel. The magnitude of the said idle travel depends on the rotational speed of the engine and the length of the closing time of the RSHLA and the latter in turn depends on the viscosity or temperature of the lubricating oil. If a constant idle travel is desired, complicated measures are required at the control valve.

A further problem of the RSHLA is shown with reference to the design of the valve body spring of EP 1 298 287 A2, which forms the generic type. This valve body spring is designed in such a manner that the valve permits a fluid transfer between the high-pressure and low-pressure space during assembly of the RSHLA but closes as quickly as possible against the spring force of the valve body spring when pressure increases in the high-pressure space. This spring force must accordingly be relatively low. The spherical valve-closing body can therefore be set in rotation by a possible lateral incident flow and can be laterally displaced with the valve body spring. As a result, the closing force of the valve body spring and consequently the idle travel of the RSHLA are changed. In the extreme case, the valve body spring may pass into the seating gap of the control valve, which may lead to further variations in the idle travel and to the detuning or even to the total failure of the RSHLA and to the destruction of the valve body spring.

OBJECT OF THE INVENTION

The invention is based on the object of providing a hydraulic valve-lash-adjusting element which has the advantages of the solution cited in the prior art but avoids its disadvantages.

SUMMARY OF THE INVENTION

The object is achieved according to the invention by a hydraulic valve-lash-adjusting element (HVA) for the valve train of an internal combustion engine, wherein

- a housing (1) has a blind bore (2) in which a piston (3) is guided with sealing clearance and is in pressure contact with a valve-actuating element (6) and its cam;
- the piston (3), together with the blind bore (2), defines a high-pressure space (4) while a low-pressure space (5) is located above the piston (3);
- the pressure spaces (4, 5) are connected by at least one central axial bore in the piston (3), this axial bore being controlled by a control valve arranged in the piston (3).

Since the upper and lower central axial bores of the piston are controlled solely by the relative movement of the said piston in relation to the stationary, mass-inert valve body, the exchange valve does not require a control valve spring. It is therefore more robust and reliable than a standard HVA or an RSHLA. In spite of the absence of reverse spring, the two central axial bores are open in the piston when the engine is at a standstill and are open in the base circle region of the cam when the engine is running. This permits an oil transfer between the pressure chambers and therefore a simple assembly of the HVA according to the invention.

An interesting feature of the exchange valve is that the latter can block the oil flow in both directions on account of the two central axial bores and the valve body which acts in either direction. Whereas the upper central axial bore is closed during the downwards movement of the piston, as occurs during each valve travel, a closing of the lower central axial bore takes place upon a sudden lash in the valve train. As a result, the piston is caused to move upwards under the spring force of the compression spring located in the high-pressure space. The lower sealing surface of the stationary valve body thereby comes into contact with the lower flat seat of the piston and closes the lower central axial bore. A further expansion of the HVA is therefore limited and pumping up thereof prevented. The same advantages with regard to thermodynamics, pollutant emission and engine stressing as in the case of an RSHLA can therefore be achieved with the exchange valve according to the invention.

There are manufacturing advantages if the valve body is of circular-cylindrical design and is guided in an axial central bore which connects the two central axial bores.

It is advantageous that, by means of interaction of preferably flat sealing surfaces of the end sides of the valve body with flat sealing surfaces of the shoulders of the piston, the oil flow through the central axial bores or between the pressure spaces can be controlled. The flat sealing surfaces afford advantages in terms of manufacturing and construction space.

For manufacturing and assembly reasons, it is advantageous that the piston has an upper part and a lower part which are both of identical design and which, after their inner contour is machined and after the valve body is installed, are connected in a mirror-inverted and pressure-tight manner.

The generously dimensioned axial flow passages on the valve body enable the flow to pass around the same at only a small flow rate during the closing operation of the exchange valve. As a result, even when there is increased viscosity of the lubricating oil, there is only low fluid friction at the valve body, with the result that only the piston movement in conjunction with the inert mass of the valve body determines the closing operation. As a result, the effect of the viscosity of the oil or of the oil temperature on the closing operation of the exchange valve is largely eliminated.

The axial flow passages can be designed as four axial grooves which are uniformly distributed on the circumference of the circular-cylindrical valve body and have a rectangular cross section.

As an alternative, there is the possibility that, in order to form axial flow passages at the ends of an alternative, circular-cylindrical valve body, four radially arranged guide elements are provided between which the flow passages are located.

The object of the invention is also achieved in the interior of a piston (3') are provided two identical, centrically arranged and axially opposite prestressing springs (29, 30) which act upon the end sides (16', 17') of the valve body (12') with pressure and keep the same in a central position between two sealing surfaces (20, 21) of the piston (3') when the exchange valve (11') is open. In order to stabilize the axial position of the valve body, in the interior of another piston are provided two identical, concentrically arranged and axially opposite prestressing springs act upon the end sides of the valve body with pressure and keep the same in a central position between two sealing surfaces of the piston when the exchange valve is open. In this manner, even if there is severe acceleration, for example due to impact loading of the HVA, a constant closing time of the exchange valve is achieved. The prestressing springs are of robust and long-lasting design in comparison to the control valve springs of the standard control valve or of the RSHLA.

It is advantageous that the piston has reinforced piston heads with inner annular grooves which are arranged coaxially with the central axial bores and serve to accommodate the prestressing springs. The space required for accommodating the prestressing springs is created in this manner.

BRIEF DESCRIPTION OF THE DRAWINGS

Further features of the invention emerge from the description below and the drawings in which exemplary embodiments of the invention are illustrated schematically.

In the drawings.

DETAILED DESCRIPTION OF THE DRAWINGS

Figure 1:
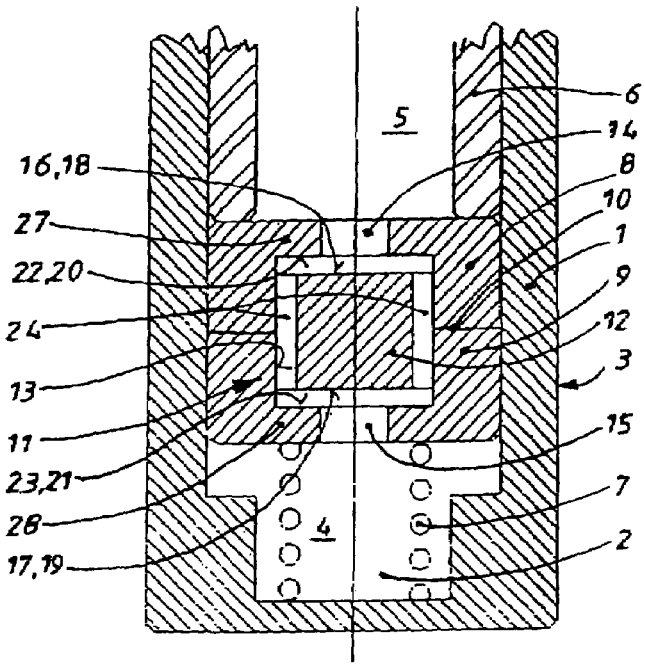
FIG. 1 shows a longitudinal section through a hydraulic valve-lash-adjusting element according to the invention with exchange valve and freely moveable valve body.

FIG. 1 shows a longitudinal section through an HVA according to the invention which has a housing 1 with a blind bore 2 in which a piston 3 is guided with sealing clearance. The position 3, together with the blind bore 2, defines a high-pressure space 4 while a low-pressure space 5 is located above the piston 3. The piston 3 is in pressure contact with a valve-actuating element 6 which is designed, for example, as a drag lever and is driven by a cam (not illustrated).

A compression spring 7 which acts upon the piston 3 with pressure in order to minimize the valve lash is located in the high-pressure space 4. In the interior of the piston is an exchange valve 11 which has a circular-cylindrical valve body 12 which is guided in a smooth-running manner in an axial central bore 13 and which controls an upper and a lower central axial bore 14, 15. The piston 3 comprises an upper part 8 and a lower part 9 which are of identical design and are arranged in a mirror-inverted manner. After the valve body 12 was installed, they are connected in a pressure-tight manner in a separating plane 10.

On its end sides 16, 17, the valve body 12 has flat sealing surfaces 18, 19 which interact with sealing surfaces 20, 21 on shoulders 22, 23 of the piston 3 in order to control the oil flow between the pressure spaces 4, 5.

Figure 2:
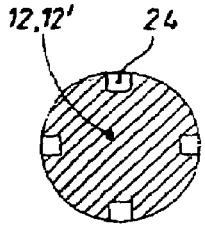
FIG. 2 shows a cross section through the valve body of FIG. 1.

Four axial grooves 24 which are uniformly distributed are provided on the circumference of the valve body 12, as is also revealed in FIG. 2. These serve for the flow connection between the two central axial bores 14, 15 and between the pressure spaces 4, 5. The rectangular cross section of the grooves 24 presents a low flow resistance to the oil flow.

The HVA according to the invention functions as follows:

In the base circle region of the cam, the pressure spaces 4, 5 of the HVA are unpressurized, with the result that the valve body 12 is located between the sealing surfaces 20, 21 of the shoulders 22, 23 of the piston 3 and an oil flow is possible between the pressure spaces 4, 5. The flow of oil which is possible as a result around the valve body 12 is so low that the position of the valve body is scarcely affected thereby. However, as soon as the cam begins to act upon the valve-actuating element, the latter is supported on the piston 3 and causes its downwards movement. Since the valve body 12 essentially retains its position in the interior of the piston 3 on account of its mass moment of inertia, its sealing surface 18 sooner or later comes into contact with the sealing surface 20 of the shoulders of the piston 3. As a result, the upper central axial bore 14 is closed and the HVA becomes hydraulically rigid.

After passing through the cam lift curve, the cam passes again into its base circle region where the internal pressure of the high-pressure space 4 is relaxed. With the beginning of the new cam lift, the next stroke of the internal combustion engine can begin.

A particular feature of the HVA according to the invention is that the exchange valve 11 blocks in both directions of movement of the piston 3. If there should be a sudden enlargement of the valve lash, for example in the base circle region of the cam, the compression spring 7 attempts to move the piston 3 upwards and therefore to pump up the high-pressure space. The upwards movement of the piston 3 soon results in the sealing surface 19 of the valve body 12, which is stationary, coming into contact with the sealing surface 21 of the shoulders 28 of the piston 3, as a result of which the lower central axial bore 15 is closed and further pumping up of the high-pressure space 4 is thereby prevented.

Figure 3:
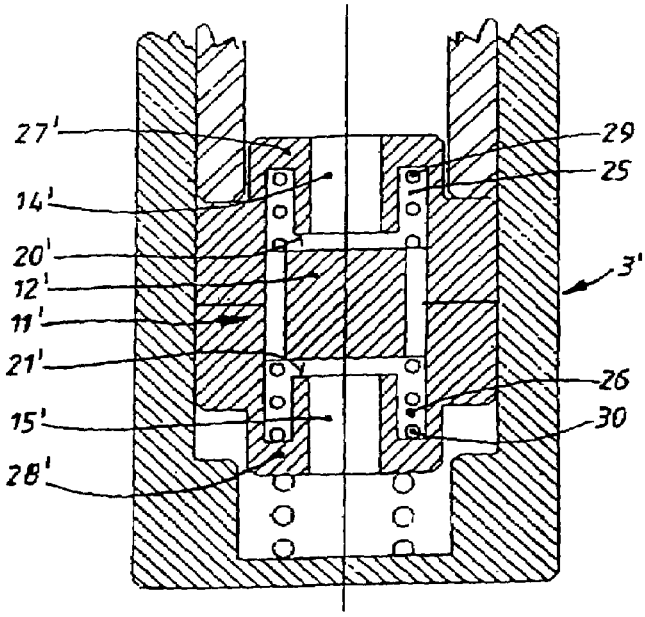
FIG. 3 shows a longitudinal section through an HVA according to the invention similar to that of FIG. 1, but with prestressing springs for the valve body.

FIG. 3 illustrates a variant of the HVA of FIG. 1 in longitudinal section. While, in FIG. 1, the valve body 12 can move freely between the sealing surfaces 20, 21 of the piston 3, the valve body 12' of FIG. 3 is kept in the central position between the sealing surfaces 20', 21' of the piston 3' by two identical, oppositely directed prestressing springs 29, 30. As a result, the starting position of the valve body 12' is always the same, even if the internal combustion engine as a whole is subjected to greater accelerations.

Otherwise the manner of functioning of the piston 3' is identical to that of the piston 3.

In order to accommodate the prestressing springs 29, 30, the piston head 27', 28' of the piston 3' is reinforced in relation to the piston head 27, 28 of the piston 3. The prestressing springs 29, 30 are accommodated in inner annular grooves 25, 26 which are arranged coaxially with the central axial bores 14', 15' in the piston head 27', 28'.

Figure 5:
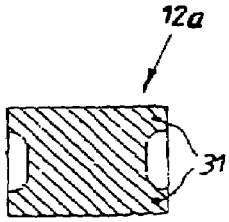
FIG. 5 shows a cross section through the valve body of FIG. 4.
Figure 4:
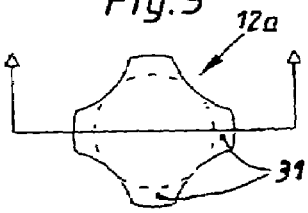
FIG. 4 shows a view of a modified valve body.

FIG. 4 illustrates a view and FIG. 5 a longitudinal section of a circular-cylindrical valve body 12*a*. The latter has preferably, at both ends, four radial guide elements 31 which are formed integrally with the same. A sufficient flow cross section is provided between the guide elements 31 in order to keep the flow rate of the oil at the valve body 12*a* and its influence on the position thereof low.

The invention claimed is:

1. A hydraulic valve-lash-adjusting element (HVA) for the valve train of an internal combustion engine, wherein:

a housing (1) has a blind bore (2) in which a piston (3) is guided with sealing clearance and is in pressure contact with a valve-actuating element (6) and its cam;

the piston (3), together with the blind bore (2), defines a high-pressure space (4) while a low-pressure space (5) is located above the piston (3);

the pressure spaces (4, 5) are connected by at least one central axial bore in the piston (3), this axial bore being controlled by a control valve arranged in the piston (3), wherein the control valve is designed as an exchange valve (11), with a valve body (12) which is guided in a smooth-running manner in the interior of the piston (3), serves to control an upper and a lower central axial bore (14, 15) and the closing movement in both directions of which is the relative movement of the piston (3) in relation to the valve body (12), which is virtually at a standstill because of its mass moment of inertia, the upper central axial bore (14) can be closed by a downwards movement of the piston (3) and the lower central axial bore (15) can be closed by the upwards movement of the said piston, the downwards movement of the piston (3) takes place by means of the cam and its upwards movement takes place by means of a compression spring (7) arranged in the high-pressure space (4), the valve body (12) is of circular-cylindrical design and is guided in an axial central bore (13) which connects the two central axial bores (14, 15), by means of interaction of preferably flat sealing surfaces (18, 19) of the end sides (16, 17) of the valve body (12) with flat sealing surfaces (20, 21) of the shoulders (22, 23) of the piston (3), the oil flow through the central axial bores (14, 15) or between the pressure spaces (4, 5) can be controlled and the piston (3) has an upper part (8) and a lower part (9) which are both of identical design and, after the valve body (12) is installed, are connected in a mirror-inverted and pressure and pressure-tight manner.

2. A HVA according to claim 1, wherein axial flow passages are arranged on the circumference of the valve body (12) and serve for the flow connection of the upper and lower central axial bores (14, 15).

3. A HVA according to claim 2, wherein four axial grooves (24) which are uniformly distributed on the circumference of the circular-cylindrical valve body (12, 12') and preferably have a rectangular cross section are provided as axial flow passages.

4. A HVA according to claim 2, wherein in order to form axial flow passages at the ends of an alternative, circular-cylindrical valve body (12*a*), four radially arranged guide elements (31) are provided between which the flow passages are located.

5. A HVA according to the precharacterizing clause of claim 1, wherein in the interior of a piston (3') are provided two identical, centrically arranged and axially opposite prestressing springs (29, 30) which act upon the end sides (16', 17') of the valve body (12') with pressure and keep the same in a central position between two sealing surfaces (20, 21) of the piston (3') when the exchange valve (11') is open.

6. A HVA according to claim 5, wherein the piston (3') has reinforced piston heads (27', 28') with inner annular grooves (25, 26) which are arranged coaxially with the central axial bores (14', 15') and serve to accommodate the prestressing springs (29, 30).

* * * * *